United States Patent [19]

Castonguay et al.

[11] Patent Number: 4,931,603

[45] Date of Patent: Jun. 5, 1990

[54] MOLDED CASE CIRCUIT BREAKER MOVABLE CONTACT ARM ARRANGEMENT

[75] Inventors: Roger N. Castonguay, Terryville; Keith W. Klein, Simsbury; David Arnold, Chester, all of Conn.; Preston L. Ellis, New Holland, Pa.

[73] Assignee: General Electric Company, New York, N.Y.

[21] Appl. No.: 327,655

[22] Filed: Mar. 23, 1989

[51] Int. Cl.[5] ..... H01H 33/02

[52] U.S. Cl. ..... 200/144 R; 200/147 R; 335/16

[58] Field of Search ..... 200/144 R, 147 R; 335/16, 201, 202

[56] References Cited

U.S. PATENT DOCUMENTS

| | | | |
|---|---|---|---|
| 3,023,292 | 2/1962 | Stewart | 200/166 |
| 3,033,964 | 5/1982 | Titus | 200/166 |
| 3,073,936 | 1/1963 | Baird | 200/168 |
| 4,160,142 | 7/1979 | Clausing | 200/254 |
| 4,240,053 | 12/1980 | Nelson et al. | 335/16 |
| 4,245,203 | 1/1981 | Wafer et al. | 335/16 |
| 4,375,021 | 2/1983 | Pardini et al. | 200/147 |
| 4,554,427 | 11/1985 | Flick et al. | 200/250 |
| 4,733,033 | 3/1988 | Morris et al. | 200/153 |
| 4,733,211 | 3/1988 | Castonguay et al. | 335/192 |
| 4,736,174 | 4/1988 | Castonguay et al. | 335/167 |
| 4,741,002 | 4/1988 | Dougherty | 377/49 |
| 4,757,294 | 7/1988 | Todaro et al. | 335/202 |
| 4,782,583 | 11/1988 | Castonguay et al. | 29/622 |
| 4,789,848 | 12/1988 | Castonguay et al. | 335/167 |
| 4,796,154 | 1/1989 | Morris et al. | 361/353 |

*Primary Examiner*—Robert S. Macon

*Attorney, Agent, or Firm*—Richard A. Menelly; Walter C. Bernkopf; Fred Jacob

[57] ABSTRACT

A molded case circuit breaker movable contact arm electrically connects with the circuit breaker load terminal without requiring a flexible electrical conducting braid. The contact arm is pivotally arranged within a contact arm support to which the load terminal lug is attached. The contact arm pivot pin is supported on a pair of parallel support posts extending from the contact arm support and a pair of bifurcated shunt plates are positioned on the pivot pin, one on each side of the contact arm to promote good electric transport between the contact arm and the support posts during short circuit conditions without interfering with the rotational movement of the contact arm.

23 Claims, 4 Drawing Sheets

MOLDED CASE CIRCUIT BREAKER MOVABLE CONTACT ARM ARRANGEMENT

BACKGROUND OF THE INVENTION

Complete automation of molded case circuit breaker components by robotic assembly has not heretofore been completely successful. One impediment to complete robotic assembly is the attachment of a flexible conductive braid between the circuit breaker contact and the circuit breaker load terminal lug.

Early attempts to eliminate the electrical contact braid are found in U.S. Pat. Nos. 3,023,292, 3,033,964 and 3,073,936 wherein a pair of contact arms are supported on a contact arm support by means of a pivot pin and a thick spring clip is fastened to the contact arm support and arranged around both the contact arms and the support. Direct electrical connection between the spring clip and the terminal conductor in some industrial-rated circuit breaker designs advantageously improves the electrical conduction between the terminal conductor and the movable contact arm by the electromagnetic forces of attraction generated by the current through the spring clip. The increasing electric current increases the electromagnetic force on the juncture between the movable contact arm and the terminal conductor to create an increasing compressive force therebetween.

In lower ampere-rated current limiting industrial circuit breakers, the forces exerted by the spring clip on the movable contact arm and the terminal conductor must remain relatively constant with increasing current to ensure that the contacts can be electrodynamically repulsed and separated under high current faults such as those occurring with short circuits. The contact arm must rapidly move about its pivot in the early stages of the current wave-form to separate the contacts with minimum let-through current at the instant of separation. This is not easily obtained when the compressive forces on the movable contact arm and the terminal conductor substantially increase at the time the movable contact arm is required to rotate about its pivot.

U.S. Pat. Nos. 4,240,053 and 4,554,427 each disclose circular segments formed within the movable contact arm that are arranged over a respective circular segment formed on the terminal conductor to form a conductive junction between the contact arm and the terminal conductor.

U.S. Pat. No. 4,160,142 utilizes a pair of washers, a nut and a bolt to connect the movable contact arm to the terminal conductor to electrically connect the contact arm with the terminal conductor.

U.S. Pat. No. 4,245,203 discloses a clinch type electrical connection between the movable contact arm and a pair of bifurcated upright posts. Clamping force upon the contact arm pivot is provided by the resilience of the posts and by a bias spring clip.

A more recent design that enables a braidless movable contact arm that is robotically assembled is described in U.S. Pat. No. 4,733,033, which Patent is incorporated herein for reference purposes. This Patent discloses the use of a spring having a planar configuration capable of holding the contact arm against its support posts with sufficient force to maintain electrical contact during overcurrent conditions. When this design is used within higher ampere-rated current limiting industrial circuit breakers, a parallel current path should be connected between the movable contact arms and the contact arm support posts to prevent the occurrence of arcing between the contact arm and the support posts under intense short-circuit overcurrent conditions.

One purpose of the instant invention accordingly is to provide a movable contact arm arrangement that includes a parallel current path between the movable contact arm and the contact arm support posts without interfering with the rapid pivotal motion of the movable contact arm during intense short circuit interruption.

SUMMARY OF THE INVENTION

A molded case circuit breaker movable contact arm is mechanically and electrically connected between a pair of support posts. A pivot pin fixedly attaches the movable contact arm to the support posts and provides electrical connection between the support posts and the movable contact arm while allowing the movable contact arm to pivot from a closed to an open position. A pair of bifurcated metallic shunt plates are arranged on the pivot pin, one on either side of the movable contact arm. The shunt plates insure good electrical connection between the movable contact arm and the support posts during intense short-circuit overcurrent conditions.

DESCRIPTION OF THE PREFERRED EMBODIMENT

Figure 1:
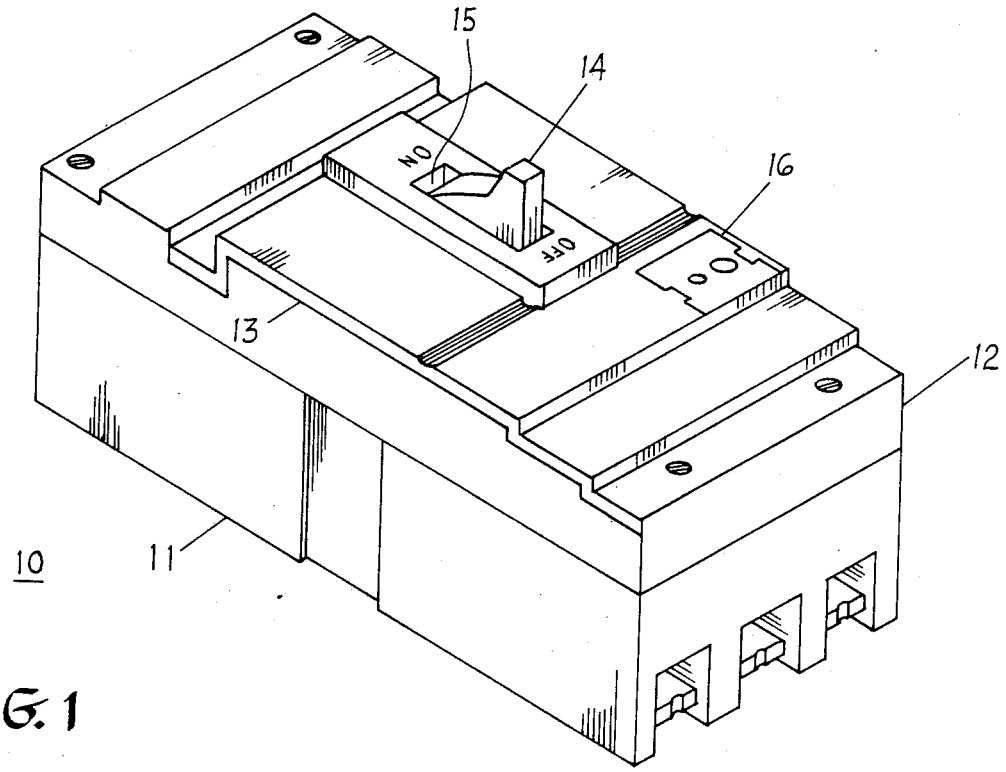
FIG. 1 is a top perspective view of a molded case circuit breaker including the movable contact arm arrangement in accordance with the invention.
Figure 2:
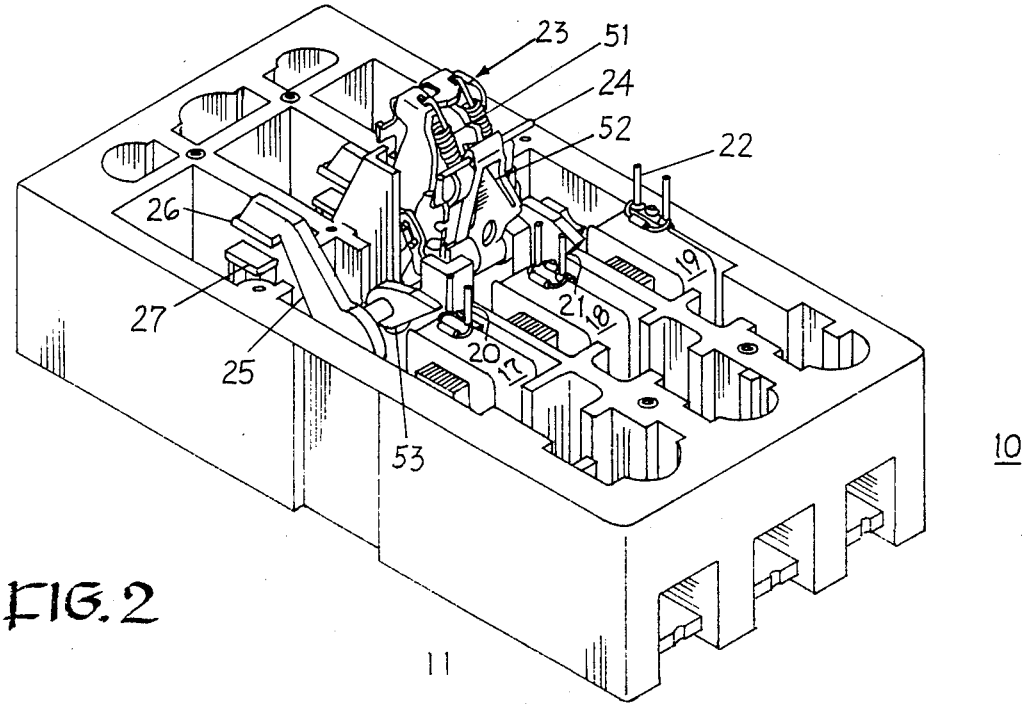
FIG. 2 is a top perspective view of the molded case circuit breaker of FIG. 1 with the cover removed to depict the circuit breaker operating mechanism assembly.

A current limiting circuit breaker 10 is depicted in FIG. 1 and consists of a case 11 to which a cover 12 is attached and which further includes an accessory cover 13. A rating plug 16 is received within the circuit breaker cover and interfaces with an electronic trip unit, also contained within the circuit breaker cover, to set the ampere rating of the trip unit circuit. The trip unit, not shown, is similar to that described within U.S. Pat. No. 4,741,002, which Patent is incorporated herein for reference purposes. A circuit breaker operating handle 14 extends upward from a slot 15 formed within the circuit breaker cover for manual intervention to turn the circuit breaker to its ON and OFF conditions. As described in U.S. Pat. No. 4,757,294, an actuator unit (not shown) interfaces between the electronic trip unit and an operating mechanism 23 by means of a trip bar 24 to separate the circuit breaker movable and fixed contacts 26, 27 best seen by referring now to FIG. 2. The operating mechanism acts upon the movable contact arm 25 to drive the movable contact arm to the open position, shown in FIG. 2, upon the occurrence of overcurrent conditions of a predetermined magnitude. The circuit current is sensed by means of current transformers 17–19 which connect with the circuit breaker trip unit by means of pins 20–22. A molded plastic crossbar arrangement 53 such as described in U.S. Pat. Nos. 4,733,211 and 4,782,583, which Patents are incorporated herein for reference purposes, carries the movable contact arm 25 to insure that the movable contact arms operate in unison when the operating mechanism 23 is articulated. The operating mechanism is held against the bias of a pair of powerful operating springs 51 by means of a latch assembly 52, such as described in U.S. Pat. Nos. 4,736,174 and 4,789,848, which Patents are incorporated herein for reference purposes. In order to provide the current limiting functions described earlier, the movable contact arms 25 are arranged for independent movement from the crossbar assembly 53 by electrodynamic repulsion acting on the movable contact arm itself. One such example of a current limiting circuit breaker is found within U.S. Pat. No. 4,375,021, which is incorporated herein for reference purposes and should be reviewed for its teachings of electrodynamic repulsion of a movable contact arm under intense overcurrent conditions through the circuit breaker contacts.

Figure 3:
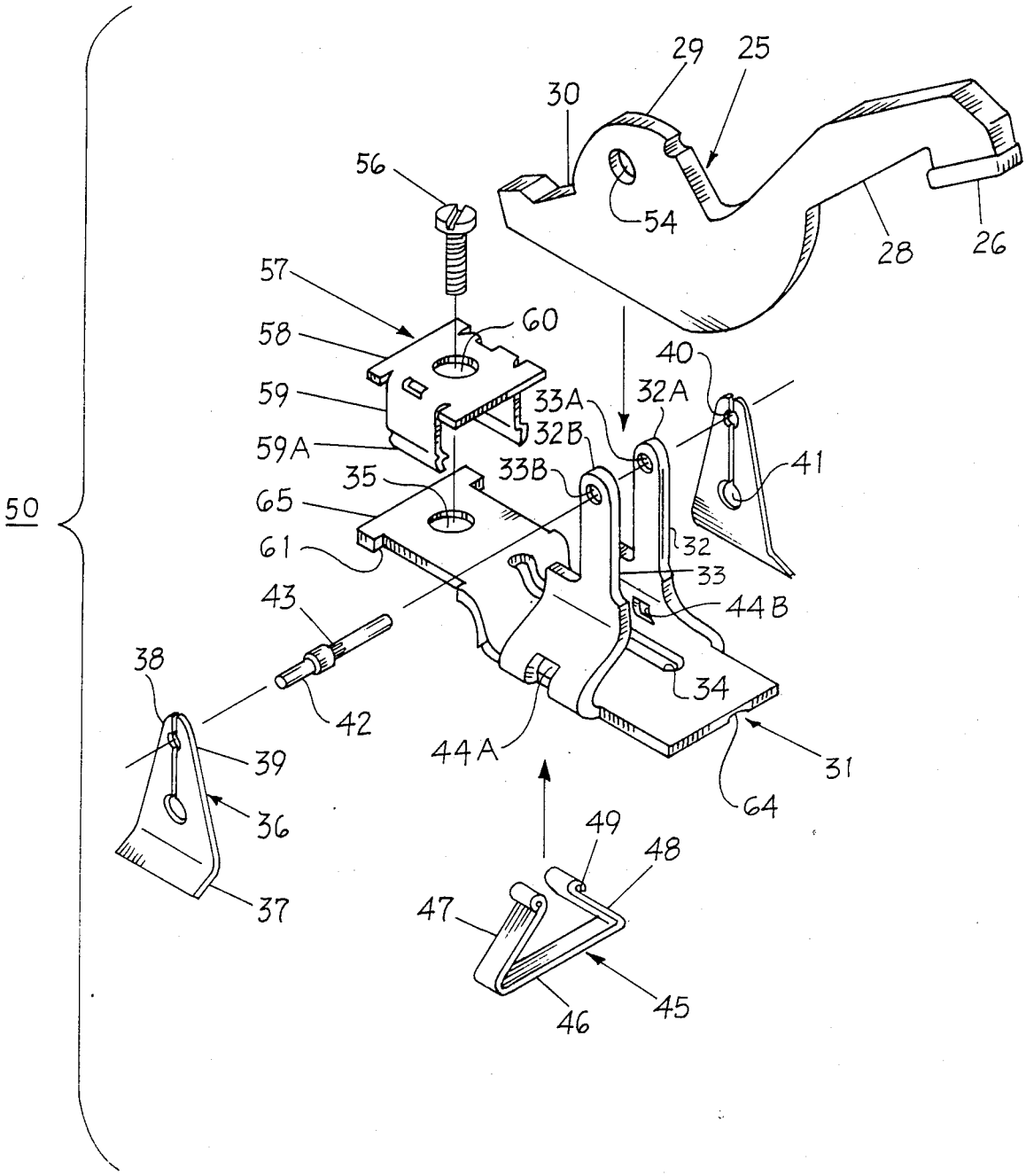
FIG. 3 is a top perspective view, in isometric projection, of the movable contact arm assembly used within the circuit breaker depicted in FIG. 1.
Figure 5:
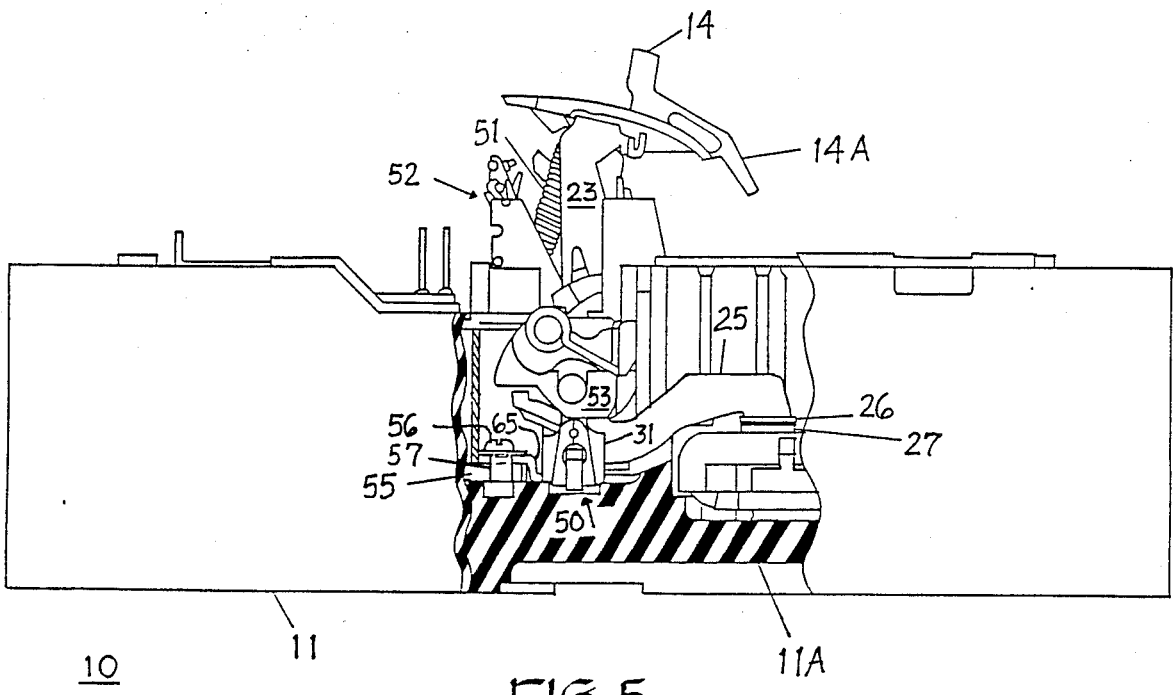
FIG. 5 is a side view, in partial section, of the molded case circuit breaker of FIG. 1 with a part of the case removed to depict the movable contact arm arrangement of the invention.

When such intense overcurrent conditions occur, it is important that the movable contact arms 25 maintain good electrical contact while the movable contacts 26 move away from the fixed contacts 27. The movable contact arrangement 50 shown in FIG. 3 improves over the braidless movable contact arm described within the aforementioned U.S. Pat. No. 4,733,033 by the addition of a pair of shunt plates 36, arranged on either side of the movable contact arm. The movable contact arm 25 which includes a central body part 29 through which a thru-hole 54 is formed, an extended forward part 28 to the end of which the movable contact 26 is attached by welding or brazing and an end part 30 integrally-formed with the body part 29 and the extended forward part 28. The movable contact arm is positioned within the circuit breaker case by means of a support base 31 which includes integrally-formed upstanding support arms 32A, 32B. The base is tempered in order for the support arms to resiliently capture the movable contact arm in a tight press-fit relation to promote good electrical conduction between the support arms and the movable contact arm. A thru-hole 35 formed within the support base 31 allows for the electrical connection of the support base with the circuit breaker load strap 55 (FIG. 5). The provision of an elongated slot 34 within the support base intermediate the upstanding support arms 32A, 32B allows for the flex of the support arms when the movable contact arm is inserted. The groove 64 formed at the end of the slot serves to control the force gradient developed between the movable contact arm and the support arms. Slots 44A, 44B formed within the support base at the juncture of the support arms 32A, 32B accurately control the gradient of the tension between the support arms and the movable contact arm. When the movable contact arm 25 is positioned within the support arms, the thru-hole 54 in the movable contact arm aligns with corresponding thru-holes 33A, 33B formed within the support arms 32A, 32B. A pivot pin 42 which includes a serated center part 43 is next inserted within the thru-holes 33A, 33B which are slightly oversized to permit rotation of the contact arm, and within thruhole 54 in a press-fit relation whereby the serated center part 43 fixedly adheres to the movable contact arm thru-hole 54. The clearance provided between the thru-holes 33A, 33B within the support arms and the ends of the pivot pin 42 allows the movable contact arm to freely rotate within the support arms while maintaining good mechanical and electrical connection between the serated part 43 of the pivot pin and the body portion 29 of the movable contact arm 25 by means of the press-fit relation attachment within the thru-hole 54. It is important to maintain good electrical contact between the pivot pin and the movable contact arm while the contact arm rotates between its closed and open position in order to deter local ionization and pitting between the contact arm and the pivot pin. In accordance with the invention, the shunt plates 36 which are formed of a conductive material, such as copper or aluminum alloys, are shaped to include bifurcated arms 38, 39 extending from an angled base 37. Openings 40 are formed within the bifurcated ends of the shunt plates for supporting the shunt plates on the ends of the pivot pin 42. A U-shaped contact spring 45 is next positioned over the shunt plates to further promote electrical connection between the shunt plates, support arms and the movable contact arm. An additional opening 41 formed within the shunt plates proximate the angled base 37 accepts the rolled ends 49 formed on the U-shaped contact spring 45 when the contact spring is positioned over the shunt plates and the support arms. The U-shaped contact spring differs from that described in aforementioned U.S. Pat. No. 4,733,033 by the provision of a pair of cantilevered arms 47, 48 integrally-formed from a single piece of spring metal and defining an intermediate bight member 46. The rolled ends 49 of the contact spring, in turn, seat within the openings 41, formed within the shunt plates 36 proximate their bifurcated ends. The rolled ends, besides accurately locating and positioning the contact spring on the shunt plates, further allows the use of a spring insertion tool to facilitate robotic assembly. The contact spring holds the shunt plates in good electrical contact with the support arms while the bifurcated arms 38, 39 of the shunt plates maintain good electrical contact between the shunt plates and the pivot pin 42. Upon the occurrence of an intense overcurrent condition, such as a short circuit, the current path between the shunt plates and the pivot pin becomes divided between the bifurcated arms 38, 39. The resulting parallel current path through the bifurcated arms electrodynamically drives the bifurcated arms against the ends of the pivot pin to maintain good electrical contact under intense short circuit overcurrent conditions. The good electrical conduction between the contact arm, pivot pin and support arms insures that no localized arcing and pitting will occur. Although two such shunt plates 36 are depicted, one on either side of the movable contact arms 25, it has been found satisfactory to use a single shunt plate on one side of the movable contact arm for lower ampere-rated circuit breakers.

An additional feature of the invention comprises the use of a shaped anti-turn screw retainer 57 which includes an integrally-formed H-shaped top part 58 with a pair of oppositely depending legs 59. The screw retainer is formed from a spring metal with the legs 59 cantilevered toward each other and having shaped ends 59A for purposes which will be described below in greater detail. The screw retainer has a thru-hole 60 formed in the H-shaped top part 58 to receive and retain a support screw 56. The support base 31 is formed to provide an off-set end 65 having a thru-hole 35, which accepts the support screw 56 to fasten the base to the circuit breaker load strap 55 (FIG. 5). A pair of slots 61 formed outboard on the offset end 65 receive the legs 59 when the screw retainer and support screw are positioned on the support base.

Figure 4:
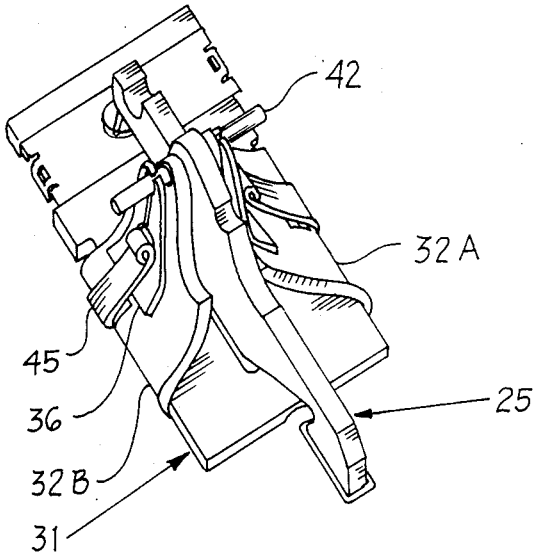
FIG. 4 is a top perspective view of the movable contact arm arrangement shown in FIG. 3.

The movable contact arm assembly 50 is depicted in FIG. 4 to show how the shunt plates 36 are forced against the support arms 32A, 32B, by the bias provided by the U-shaped contact spring 45. The pivot pin 42 is shown extending through the movable contact arm 25, the support arms 32A, 32B and the shunt plates 36.

The circuit breaker 10 is shown in FIG. 5 with the movable contact arm assembly 50 attached to the bottom 11A of the circuit breaker case 11. The offset end 65 of support base 31 is attached to both the load strap 55 and the bottom of the case by means of a screw 56. The movable contact arm 25 is shown positioned under the crossbar 53 above which the operating mechanism 23 is supported. The movable contact arm 25 is arranged with the movable contact 26 and fixed contact 27 in their closed positions against the bias of the operating springs 51. As described earlier, the latch assembly 52 maintains the contacts in their closed positions in the absence of any overcurrent conditions through the contacts. The operating handle 14 is attached to the operating mechanism by means of the handle shroud 14A in the manner described within U.S. Pat. No. 4,796,154.

Figure 6A:
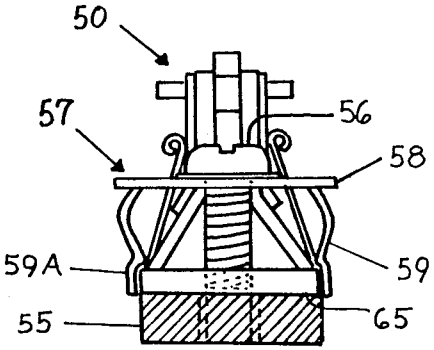
FIGS. 6A and 6B are end views of the movable contact arm assembly shown in FIG. 4.
Figure 6B:
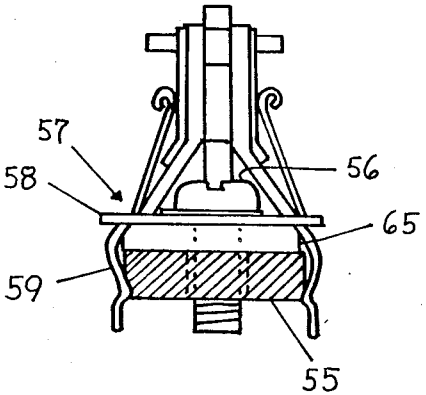

The arrangement of the screw retainer 57 on the movable contact arm assembly 50 is best seen by referring now to FIGS. 6A and 6B. When the screw retainer 57 is first assembled on the off-set end 65 of the contact arm assembly 50, the radial-shaped ends 59A of the legs 59 engage the side of the offset end 65, which positions the screw 56 captured within the H-shaped top part 58 and positions the screw over the load strap 55. When the screw 56 is later attached to the load strap, as shown in FIG. 6B, the screw retainer 57 is forced downwards such that the legs 59 straddle both the offset end 65 and the load strap 55.

Figure 7:
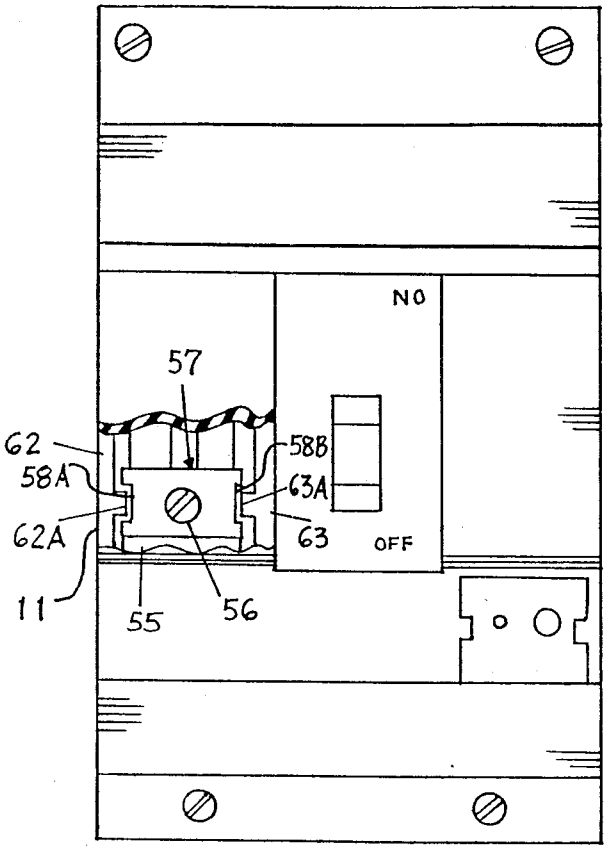
FIG. 7 is a plan view of the circuit breaker shown in FIG. 1 with a part of the cover removed to show the anti-turn screw retainer according to the invention.

The anti-turn feature of the screw retainer 57 is best seen by referring now to FIG. 7, wherein the screw retainer is shown with a portion of the cover 12 removed to show a part of the circuit breaker case 11 and with the screw 56 fastened tightly to the load strap 55. The case side walls 62 are formed with projections 62A that are received within corresponding slots 58A on one side of the H-shaped top part 58. The interior barrier wall 63 of the circuit breaker case is similarly formed with a projection 63A, which is captured within a slot 58B formed within the opposite side of the H-shaped top part 58. When torque is applied to the screw 56 to securely fasten the screw to the load strap, any torque generated within the screw retainer 57 is transmitted via slots 58A, 58B to the corresponding projection 62A, 63A and removes any stress which might otherwise be transmitted via the offset end 65 of the support base 31 up to the support arm 32, 33, shown in FIG. 3, and from there to the movable contact arm 25 via the pivot pin 42. The provision of the anti-turn feature to the screw retainer is an important feature of this invention.

It is thus seen that a circuit breaker movable contact arm assembly allows independent movement of the movable contact arm upon the occurrence of intense overcurrent conditions through the circuit breaker contacts. A pair of shunt plates arranged on opposite sides of the contact arm assembly insures good electrical contact between the contact arm support and the contact arm pivot to prevent any adverse arcing between the contact arm pivot and the contact arm during such overcurrent conditions.

Having thus described our invention, what we claim as new and desire to secure by Letters Patent is:

1. A molded case circuit breaker contact arm arrangement comprising:

an elongated movable contact arm having a contact attached at one end and a thru-hole arranged through an opposite end;

a support comprising a pair of upstanding support arms extending from a base;

a pivot pin arranged through said support arms and said thru-hole for rotation of said contact arm between closed and open positions;

a first planar shunt plate arranged on one side of said support arms, said first shunt plate comprising a pair of bifurcated arms extending from a bottom part; and a U-shaped contact spring arranged over said shunt plate and one of said support arms to hold said first shunt plate in contact with said one support arm.

2. The molded case circuit breaker contact arm arrangement of claim 1 including a second shunt plate arranged on an opposite side of said support arms.

3. The molded case circuit breaker contact arm arrangement of claim 1 wherein said support includes an opening at one end for receiving an electric terminal screw.

4. The molded case circuit breaker contact arm arrangement of claim 1 including a first thru-hole in each of said shunt plates, said pivot pin being arranged through said first thru-hole.

5. The molded case circuit breaker contact arm arrangement of claim 3 including a second thru-hole in each of said first and second shunt plates beneath said first thru-hole, one end of said contact spring being contained within said second thru-hole.

6. The molded case circuit breaker contact arm arrangement of claim 4 wherein said contact spring one end is formed-over to define a tool-accepting cavity.

7. The molded case circuit breaker contact arm arrangement of claim 1 wherein said contact spring comprises a pair of arms extending from a support bight, said arms being cantilevered toward each other to provide tension to said shunt plates and to enhance electrical connection between said movable contact arm and said support arms.

8. The molded case circuit breaker contact arm arrangement of claim 1 wherein said pivot pin includes a serated part which forms a press-fit relation with said contact arm to enhance electric transfer between said contact arm and said pivot pin.

9. The molded case circuit breaker contact arm arrangement of claim 1 wherein said support arms are tempered to provide uniform tension between said support arms and said movable contact arm.

10. The molded case circuit breaker contact arm arrangement of claim 1 wherein said support base includes an elongated slot.

11. The molded case circuit breaker contact arm arrangement of claim 10 wherein said support base further includes a pair of slots intermediate said support arms and said elongated slot.

12. The molded case circuit breaker contact arm arrangement of claim 10 further including a notch on one end of said support base proximate said elongated slot.

13. A current limiting circuit breaker comprising in combination:

a molded plastic case and cover;

a pair of separable contacts within said case under control of a circuit breaker operating mechanism for moving said contacts between closed and open conditions;

a movable contact arm assembly comprising:

an elongated movable contact arm having a contact attached at one end and a thru-hole arranged through an opposite end;

a support comprising a pair of upstanding support arms extending from a base;

a pivot pin arranged through said support arms and said thru-hole for rotation of said contact arm between closed and open positions;

a pair of planar shunt plates arranged on opposite sides of said support arms, each of said shunt plates comprising a pair of bifurcated arms extending from a bottom part; and a U-shaped contact spring arranged over said shunt plates and said support arms to hold said shunt plates in electric contact with said support plates.

14. The current limiting circuit breaker of claim 13 wherein said support includes an opening at one end for receiving an electric terminal screw.

15. The current limiting circuit breaker of claim 13 including a first thru-hole in each of said shunt plates, said pivot pin being arranged through said first thru-hole.

16. The current limiting circuit breaker of claim 13 including a second thru-hole in each of said shunt plates beneath said first thru-hole, one end of said contact spring being contained within said second thruhole.

17. The current limiting circuit breaker of claim 13 wherein said contact spring one end is formed-over to define a tool-accepting cavity.

18. The current limiting circuit breaker of claim 13 wherein said pivot pin includes a serated part which forms a press-fit relation with said contact arm to enhance electric transfer between said contact arm and said pivot pin.

19. A current limiting circuit breaker comprising in combination:

a molded plastic case and cover said case including a pair of opposing side walls and a plurality of intervening barrier walls integrally-formed therein and at least one load terminal strap intermediate one of said end walls and one of said barrier walls;

a pair of separable contacts within said case under control of a circuit breaker operating mechanism for moving said contacts between closed and open conditions;

a movable contact arm assembly comprising: an elongated movable contact arm having a contact attached at one end and a thru-hole arranged through an opposite end;

a support comprising a pair of upstanding support arms extending from a base and having an offset end arranged for receiving a load terminal screw, said movable contact arm being supported between said support arms;

a pivot pin arranged through said support arms and said thru-hole for rotation of said contact arm between closed and open positions; and a terminal screw retainer arranged on said offset end and comprising a one-piece U-shaped clip having a planar bight member and a pair of legs depending from said bight member, said bight member having a pair of slots formed within opposing ends thereof.

20. The current limiting circuit breaker of claim 20 wherein said side walls and said barrier walls include corresponding elongated projections whereby said slots capture said projections to provide anti-turn facility to said screw retainer.

21. The current limiting circuit breaker of claim 20 wherein said offset end includes a pair of slots formed within opposite ends, said screw retainer legs being shaped at their ends to grip said offset end within said slots when said screw retainer is first positioned on said offset end.

22. The current limiting circuit breaker of claim 22 wherein said screw retainer comprises a spring metal.

23. The current limiting circuit breaker of claim 22 wherein said retainer legs are cantilevered toward each other whereby said retainer legs envelope said offset end and said load terminal strap when said load terminal screw is fastened to said load terminal strap.

* * * * *